US005622057A

United States Patent [19]

Bussjager et al.

[11] Patent Number: 5,622,057

[45] Date of Patent: Apr. 22, 1997

[54] HIGH LATENT REFRIGERANT CONTROL CIRCUIT FOR AIR CONDITIONING SYSTEM

[75] Inventors: Ruddy C. Bussjager, Chittenango; James M. McKallip, Pompey; Lester N. Miller, East Syracuse, all of N.Y.

[73] Assignee: Carrier Corporation, Syracuse, N.Y.

[21] Appl. No.: 520,896

[22] Filed: Aug. 30, 1995

[51] Int. Cl.[6] ..... F25B 41/04

[52] U.S. Cl. ..... 62/173; 62/176.5; 62/176.6

[58] Field of Search ..... 62/173, 176.5, 62/176.6, 196.4, 90, 176.1

[56] References Cited

U.S. PATENT DOCUMENTS

| | | | |
|---|---|---|---|
| 3,257,822 | 6/1966 | Abbott | 62/173 |
| 3,264,840 | 8/1966 | Harnish | 62/176.5 X |
| 3,798,920 | 3/1974 | Morgan | 62/173 |
| 4,984,433 | 1/1991 | Worthington | 62/176.5 X |

OTHER PUBLICATIONS

BDP Company, Engineering Data Release for Model 542E Packaged Heat Pump, (pp. 2 and 5). Aug. 1979.

"Heat Pipes Can Enhance Air Conditioning Systems," Air Conditioning, Heating & Refrigeration News, Jun. 5, 1995.

*Primary Examiner*—Harry B. Tanner

[57] ABSTRACT

A high latent cooling control assembly for a compression-expansion air conditioning system employs a subcooler coil disposed in the leaving air side of the indoor air evaporator coil. A liquid line branch supplies condensed liquid refrigerant from the condenser to the subcooler coil, and a flow restrictor, which can be a TXV, drops the sub-cooled liquid pressure before the refrigerant reaches the expansion device associated with the evaporator coil. A bypass line connects the condenser to the expansion device, and has a liquid line solenoid valve that is humidistat actuated. When dehumidification is called for, the solenoid is closed and refrigerant flows through the subcooler coil. When the humidistat is satisfied, the solenoid opens and the refrigerant path bypasses the subcooler coil. The high latent subcooler assembly can be field-installed or retrofitted onto an existing air conditioner.

9 Claims, 4 Drawing Sheets

HIGH LATENT REFRIGERANT CONTROL CIRCUIT FOR AIR CONDITIONING SYSTEM

BACKGROUND OF THE INVENTION

This invention relates to compression/expansion refrigeration, and is particularly concerned with air conditioning systems wherein a sub-cooler is employed to reduce the relative humidity, that is, to increase the amount of latent cooling in the air leaving the indoor air evaporator.

Single-fluid two-phase air conditioning and refrigeration systems typically employ a compressor that receives the two-phase working fluid as a low temperature, low-pressure vapor and discharges it as a high temperature, high-pressure vapor. The working fluid is then passed to an outdoor condenser coil or heat exchanger, where the heat of compression is discharged from the working fluid to the outside air, condensing the working fluid from vapor to liquid. This high-pressure liquid is then supplied through an expansion device, e.g., a fixed or adjustable expansion valve or a pressure-reducing orifice, and then enters an indoor evaporator coil at low pressure. At this stage, the working fluid is a bi-phase fluid (containing both liquid and vapor phases), and absorbs heat from the indoor, comfort-zone air, so that the liquid phase is converted to vapor. This completes the cycle, and the vapor returns to the suction side of the compressor.

When warm indoor air passes through the evaporator coil, its temperature is lowered as it loses heat to the cold evaporator coil. As the air temperature is reduced to or below the dewpoint, moisture condenses on the evaporator coil and is removed from the indoor air. The actual temperature of the leaving air is reduced (i.e., sensible cooling), and the air is also dehumidified (i.e., latent cooling). The amount of latent cooling, or dehumidification, depends on whether the moisture in the indoor air will leave the air and condense on the evaporator coil.

Condensation of water vapor in the indoor air will take place only if the evaporator coil temperature is below the dewpoint of the air passing through, dewpoint being understood to be the temperature at which the water condenses in air.

Current standards on indoor air quality stress the need for controlled humidity in occupied spaces. High humidity has been identified as a major contributory factor in the growth of pathogenic or allergenic organisms. Preferably, the relative humidity in an occupied space should be maintained at 30% to 60%. In addition to adverse effects on human comfort and human health, high humidity can contribute to poor product quality in many manufacturing processes, and can render many refrigeration systems inefficient, such as open freezers in supermarkets. Also high humidity can destroy valuable works of art, library books, or archival documents.

In very, warm, humid conditions, a conventional air conditioner as just described can use up most of its cooling capacity to cool the air to the dewpoint (sensible cooling), and will have little remaining capacity for dehumidification (latent cooling).

The conventional approach to this problem of removing large mounts of humidity in a hot, humid environment has been to operate the air conditioner longer, by lowering the thermostat setpoint and over-cooling the air. This of course means that the air conditioner has to operate longer and will consume more energy. In addition, this practice results in blowing uncomfortably cold air onto persons in the indoor comfort space. In essence, overcooling lowers the temperature of the evaporator coil to allow more condensation on the coil. However, this makes the supply air too cold for human comfort. In order to restore the indoor air to a comfortable temperature, it is sometimes the practice to reheat the leaving supply air before it is returned to the comfort space. The indoor air temperature is raised to a comfortable level using either a heating element or a coil carrying the hot compressed vapor from the compressor, to raise the temperature (and reduce the relative humidity) of the overcooled air. In the case of either the heating element or the hot vapor coil, more energy is required.

One recent proposal for increasing the latent cooling of an air conditioning system, at low energy cost, has been a heat pipe. A heat pipe is a simple, passive arrangement of interconnected heat exchanger coils that contain a heat transfer agent (usually a refrigerant such as R-22). A heat pipe system can increase the dehumidification capacity of an air conditioning system, and reduce the energy consumption relative to the overcooling/reheating practice described just above. The heat pipe system is attractive because it can transfer heat from one point to another without the need for energy input. One heat exchanger of the heat pipe is placed in the warm air entering the evaporator, and the other heat exchanger is placed in the cold air leaving the evaporator. The entering air warms the refrigerant in the entering side heat exchanger of the heat pipe system, and the refrigerant vapor moves to the leaving side heat exchanger, where it transfers its heat to the leaving air and condenses. Then the condensed refrigerant recirculates, by gravity or capillary action, back to the entering side heat exchanger, and the cycle continues.

The heat pipe system built into an air conditioner can increase the amount of latent cooling while maintaining the sensible cooling at the preferred comfortable thermostat setpoint. In circumstances where the need for moisture removal is high, or where it is critical to keep the relative humidity below some point, the standard air conditioning system may not be able to deal effectively with high temperature and high humidity cooling loads. However, a heat-pipe enhanced air conditioning system cools the entering air before it reaches the air conditioner's evaporator coil. The entering side heat pipe heat exchanger pre-cools the entering air, so that less sensible cooling is required for the evaporator coil, leaving a greater capacity for latent cooling or dehumidification. The indoor supply air leaving the evaporator, being colder than the desired temperature, condenses the vapor in the leaving side heat pipe heat exchanger, which brings the supply air temperature back to the desired comfort temperature.

While the heat pipe arrangement does have certain advantages, such as passivity and simplicity, it has disadvantages as well. For example, the heat pipe is always in circuit, and cannot be simply turned off, even when increased sensible cooling without dehumidification is called for. In addition, because there are two heat-pipe heat exchanger coils in the indoor air path in addition to the evaporator coil, the indoor air flow can be significantly restricted. Also, it can be difficult to retrofit an existing air conditioner to accommodate the two additional coils in the same cabinet as the evaporator, and quite often a considerable amount of equipment has to be repositioned, and the cabinet enlarged, to accommodate the heat pipe.

OBJECTS AND SUMMARY OF THE INVENTION

Accordingly, it is an object of the present invention to provide an air conditioning system with controllable mechanism for enhancing the latent cooling capacity of an air conditioner.

It is another object to provide a controllable mechanism for reducing the relative humidity of the leaving indoor or supply air and which avoids the drawbacks of the prior art.

It is a further object to provide a subcooler mechanism which can be easily retrofit into an existing air conditioning system, and which will improve the latent cooling capacity of the system at a minimum of capital cost and a minimum energy cost.

In accordance with an aspect of the present invention, a subcooler heat exchanger is positioned on the leaving side of the indoor evaporator coil. The subcooler heat exchanger has an inlet coupled to the outlet side of the condenser heat exchanger, so that the liquid refrigerant at high pressure flows to the subcooler heat exchanger. The latter also has an outlet coupled though a flow restrictor device, and thence through the expansion device to the evaporator coil. A bypass liquid line directly couples the condenser with the expansion device to the evaporator coil, and there is a liquid-line solenoid valve interposed in the bypass liquid line. When normal cooling is called for (i.e., dehumidification is not needed) the liquid-line solenoid valve is open, and the refrigerant bypasses the sub-cooler. However, when both cooling and dehumidification are called for, e.g., when a humidistat signals a high relative humidity condition, the solenoid valve is closed, and the liquid refrigerant is routed through the subcooler. In this case, this has the effect of sub-cooling the liquid refrigerant in the cold leaving air, which increases the refrigerant cooling capacity. Then the sub-cooled refrigerant is fed to the evaporator, which cools the indoor air to a desired wet-bulb temperature and condenses moisture to that temperature. Then the leaving air passes through the subcooler, which brings the leaving indoor air or supply air to the desired indoor comfort temperature.

When the subcooler is in circuit, there is a first pressure drop across the flow restrictor device for the sub-cooled liquid exiting the subcooler, and then a second pressure drop across the expansion device for the liquid entering the evaporator coil. When the solenoid is actuated to bypass the liquid refrigerant around the subcooler, the flow restrictor device creates a much higher flow impedance path for the sub-cooled liquid, so the large majority of the liquid refrigerant flows directly from the condenser through the expansion device into the evaporator coil. Preferably, the solenoid is configured so that, in the event of failure, the fluid flow will be in the bypass mode. The solenoid valve can be line-powered (e.g. 120 v.a.c.) or thermostat powered (e.g. 24 v.a.c.).

The air conditioning apparatus is controlled by a thermostat with a cooling lead that supplies a signal to actuate the compressor whenever a cooling setpoint temperature is reached or exceeded. In an embodiment of this invention, a humidity control line is coupled to the thermostat cooling lead, and includes a humidistat in series with the liquid line solenoid valve or with a control relay that actuates the solenoid valve. The humidity control lead can also have a low pressure switch that is in fluid communication with the suction side of the compressor for detecting a low-pressure condition on the suction side of the compressor, which could be indicative of frost or ice on the evaporator.

The air conditioner can have a two-stage thermostat, where a second cooling lead is energized when a second, higher setpoint is reached. In a possible embodiment, the control for humidity reduction can include a control relay coupled to the second cooling lead, and having power leads that are in series with the humidity control line. In another possible embodiment, the air conditioner can include two separate air conditioning systems, each having its own compressor, condenser, expansion device, evaporator, and subcooler, with one air conditioning system actuated by the first cooling lead and the other air conditioning system actuated by the second cooling lead.

The above and many other objects, features, and advantages of this invention will become apparent from the ensuing description of selected preferred embodiments, which are to be considered in connection with the accompanying Drawing.

DETAILED DESCRIPTION OF THE PREFERRED EMBODIMENTS

Figure 1:
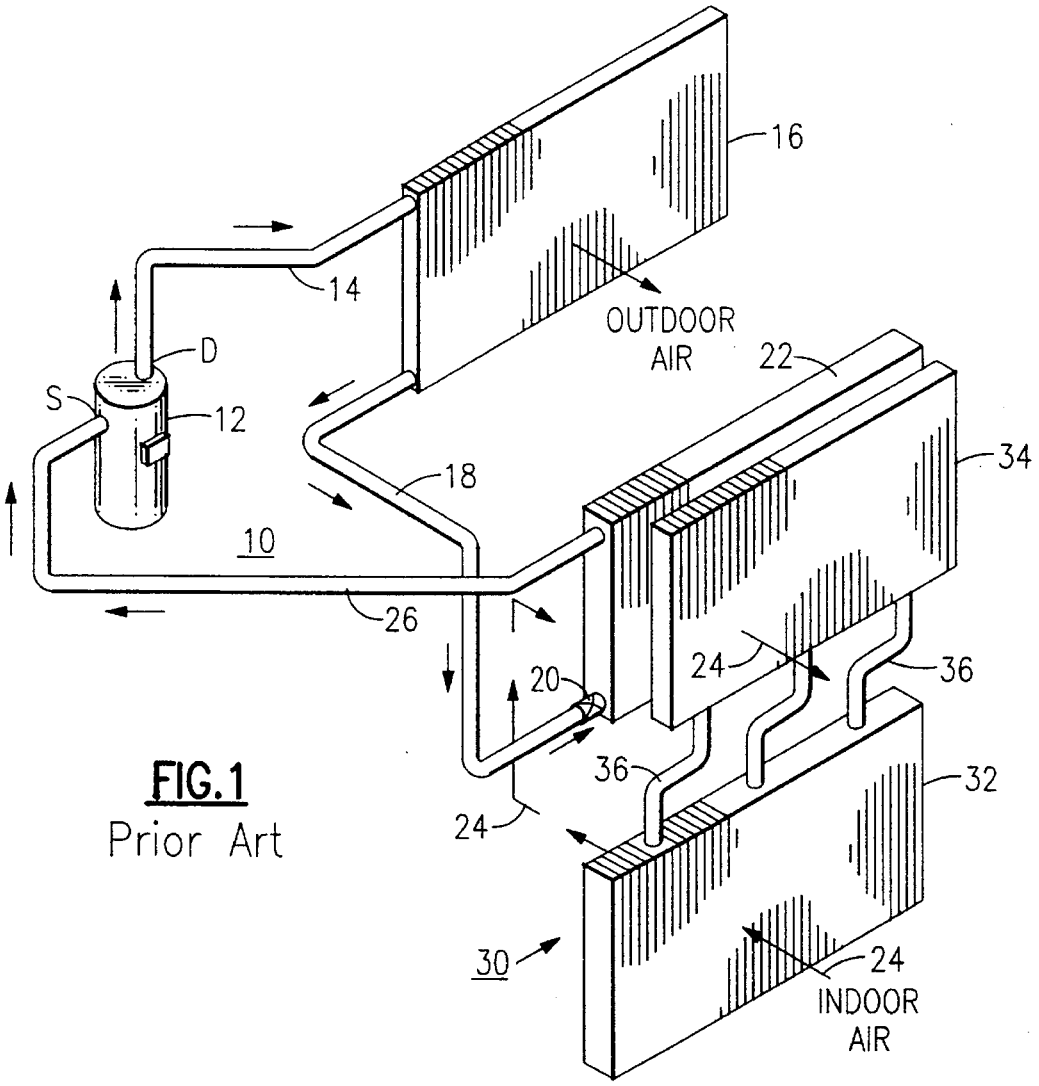
FIG.1 Prior Art
FIG. 1 is a schematic view of an air conditioning system employing a heat-pipe enhancement according to the prior art.

With reference to the Drawing, and initially to FIG. 1, an air conditioning system 10 is configured to provide air conditioning and dehumidification to an indoor comfort zone. With some modifications, which would be known to persons in this an, the system 10 could also be configured as a heat pump to provide heating to the indoor comfort zone and also provide hot water. Here, in this air conditioner system 10, a compressor 12 receives a refrigerant vapor at low pressure at a suction inlet S and discharges the refrigerant vapor at high pressure from a discharge or pressure port D. The compressed refrigerant vapor proceeds from the compressor along a pressure line 14 to an outdoor condenser heat exchanger 16. In the condenser the refrigerant vapor expels its heat to the outside air, and condenses as a liquid. From the condenser heat exchanger 16, the liquid refrigerant, at high pressure, travels through a liquid line 18 to an expander device 20 and thence into an indoor air cooling coil or evaporator heat exchanger 22. The expander device can be any suitable throttling device which will deliver the refrigerant to the evaporator 22 as a bi-phase (both liquid and vapor) fluid at low pressure. In one presently-preferred embodiment, the expander device 20 can be a pair of spaced orifice plates (e.g., so-called "Dixie cups") brazed into the inlet to the evaporator 22. The evaporator heat exchanger is a coil in which the refrigerant absorbs heat from a stream 24 of indoor air that passes over the coil and is returned to the building indoor comfort space. A vapor line 26 carries the vapor from the evaporator heat exchanger 22 back to the suction port S of the compressor, where the compression-condensation-expansion-evaporation cycle is repeated.

In the air conditioning system of FIG. 1, dehumidification is accomplished using a heat pipe arrangement 30 according to the prior art. The heat pipe arrangement is associated with the cooling coil or evaporator heat exchanger 22, and comprises a pair of heat exchanger coils and interconnecting tubing, with an entering air coil 32 disposed on the indoor air stream 24 on the entering or return side of the evaporator coil 22, and a leaving air coil 34 on the leaving air or supply side of the coil 22. Interconnecting tubing 36 permits transfer of a working fluid (usually a refrigerant) between the two coils 32 and 34. The heat pipe arrangement 30 absorbs heat from the entering room air, at relatively high humidity, removing some of the cooling load from the evaporator coil 22 and transfers the heat to the leaving air. For example, the entering room air in the air stream 24 can have a temperature of 78 degrees (Fahrenheit), and the heat pipe coil 32 reduces the sensible temperature of the entering air to about 69 degrees. This lowers the entering air dry-bulb temperature, and brings the entering air closer to its dew-point. The evaporator heat exchanger 22 cools the air stream to a temperature of 49 degrees and condenses moisture, which collects in a drip pan (not shown). Then the over-cooled leaving air passes through the heat pipe coil 34, and its sensible temperature is restored to a more comfortable level, e.g., 59 degrees. The wet-bulb temperature remains at 49 degrees, so the indoor air relative humidity is reduced well below what would have been achieved without the heat pipe arrangement 30.

The heat pipe arrangement as described here has the attractive features of simplicity, requiring no moving parts, relatively low cost, and low maintenance. Heat pipe assemblies can be retrofitted into existing equipment, although in most cases some equipment modification is necessary to fit the coils 32 and 34 into the existing equipment space provided. On the other hand, the heat pipe arrangement is always in line, and cannot be switched off, for example when additional sensible cooling is needed, but dehumidification is not needed or not important. There are no electrical or mechanical controls associated with the heat pipe arrangement. Also, in some conditions, moisture condensation can actually take place on the entering air heat pipe coil 32, causing the condensate to drip into the equipment cabinet. It is also apparent that the indoor air stream has to pass through three coils, namely the heat pipe coils 32 and 34 in addition to the evaporator coil 22, thereby increasing the indoor-air fan load.

The present invention addresses the problems that are attendant with heat pipe systems, and permits the air conditioning system to achieve additional humidity removal, when needed, but also achieve a standard amount of latent cooling, i.e., more sensible cooling, when humidity control is less important.

Figure 2:
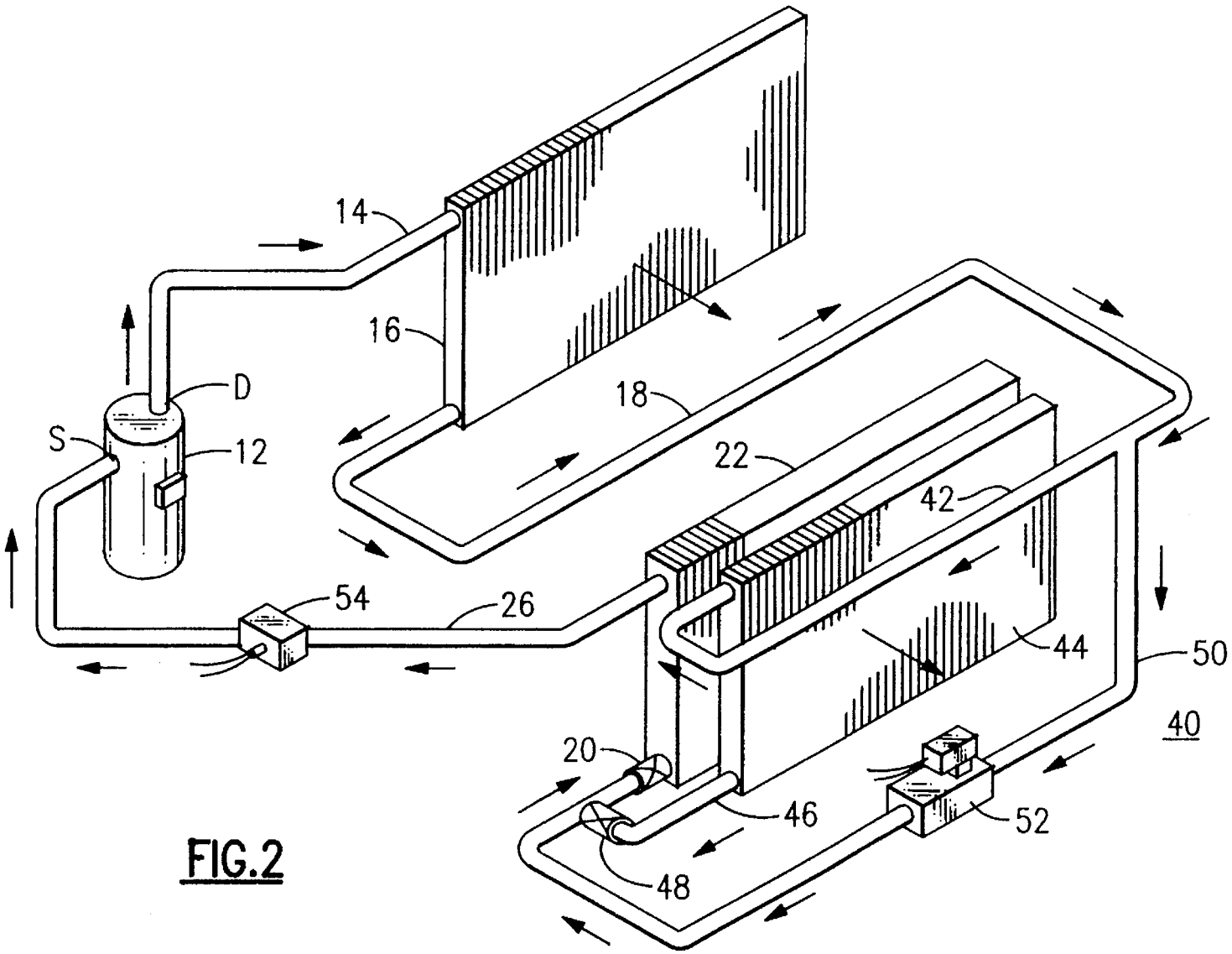
FIG. 2 is a schematic view of an air conditioning system employing a subcooler, according to an embodiment of this invention.

An air conditioning system according to one embodiment of the present invention is shown in FIG. 2, in which the elements or parts that were described earlier in reference to FIG. 1 are identified with the same reference numbers. Accordingly, a detailed description of the basic air conditioning system need not be repeated. In this embodiment, rather than a heat pipe arrangement, the air conditioning system includes a sub-cooler assembly 40 for subcooling the liquid refrigerant in the leaving indoor air from the evaporator 22. To the high-pressure liquid line 18 is connected a sub-cooler branch line 42 that supplies the liquid refrigerant to a subcooler heat exchanger coil 44 that is positioned in the indoor air stream 24 on the leaving side of the evaporator coil 22. This coil 44 cools the condensed liquid refrigerant and supplies the subcooled liquid through a sub-cool liquid line 46 to the evaporator. The line 46 includes a flow restrictor 48, in this case a fixed flow restrictor. The sub-cooled liquid passes in series through the flow restrictor 48, and then through the expansion device 20, to enter the evaporator coil 22 as a bi-phase fluid. One possible example of the flow restrictor is described in Honnold, Jr. U.S. Pat. No. 3,877,248, although many other flow restriction devices could be employed in this role. Such a fixed flow restrictor can be a so-called accurator, which is a machined brass slug approximately one-half inch (1.2 cm) long with a through-hole of a predetermined diameter. The diameter of the hole is selected to match a given refrigerant and a pressure drop corresponding to a given operating condition. The accurator body can be interchanged to match the typical operating conditions for a given air conditioning installation. The accurator must ensure that the refrigerant reaching the expansion device 20 has enough remaining pressure to be liquid rather than two-phase fluid. A liquid bypass line 50 couples the liquid line 18 to the expansion device 20 and evaporator coil 22, bypassing the subcooler heat exchanger coil 44 and the flow restrictor 48. There is a liquid line solenoid valve 52 in the bypass line 50, which is controlled to close the bypass line when dehumidification (additional latent cooling) is called for, and to open when normal cooling is called for. The fixed flow restrictor creates a pure pressure drop to bring the refrigerant liquid down to a pressure that is acceptable for the existing expansion device 20. This enables the sub-cooler assembly 40 to be provided as a "drop-in" enhancement or accessory, with little physical impact on the existing system 10. The bypass line 50 and solenoid 52 are used to route the refrigerant liquid around the subcooler, enabling the subcooler assembly 40 to be either "in" or "out" of the circuit. If the liquid line solenoid 52 is open, the subcooler coil 44 is effectively out of the circuit. The refrigerant flow takes the path of least resistance along the bypass line 50, while the flow restrictor 48 creates an impedance to keep the flow through the subcooler coil 44 to an insignificant level. On the other hand, when the solenoid valve 52 is closed, all of the liquid refrigerant is routed through the subcooler coil 44. Having the bypass solenoid valve 52 open, with the subcooler coil out of the circuit, enables the system to reach its full sensible cooling effect without added latent cooling effect. Then the bypass liquid line solenoid valve 52 is closed, the refrigerant flows through the subcooler coil 44, and the evaporator coil 22 and subcooler coil 44 provide a full dehumidification effect.

When the subcooler assembly 40 is in circuit, the sub-cooler coil 44 warms the air leaving the evaporator coil 22 and subcools the liquid refrigerant being supplied from the condenser coil 16. The subcooled refrigerant liquid has its pressure dropped by the flow restrictor 48, and then passes through the throttling device or expansion device 20 and enters the evaporator or cooling coil 22. The indoor air stream is cooled to a suitable low temperature, e.g., 49 degrees F as discussed previously, and moisture is condensed from the indoor air. Then the subcooler coil 44 warms the leaving air to bring the sensible temperature back to a comfortable level, e.g. 59 degrees.

The air conditioner system 10 here also employs a compressor low-pressure switch 54 that is operatively coupled to the vapor return line 26 and senses when compressor suction pressure is too low, for guarding against evaporator freeze-up.

Figure 3:
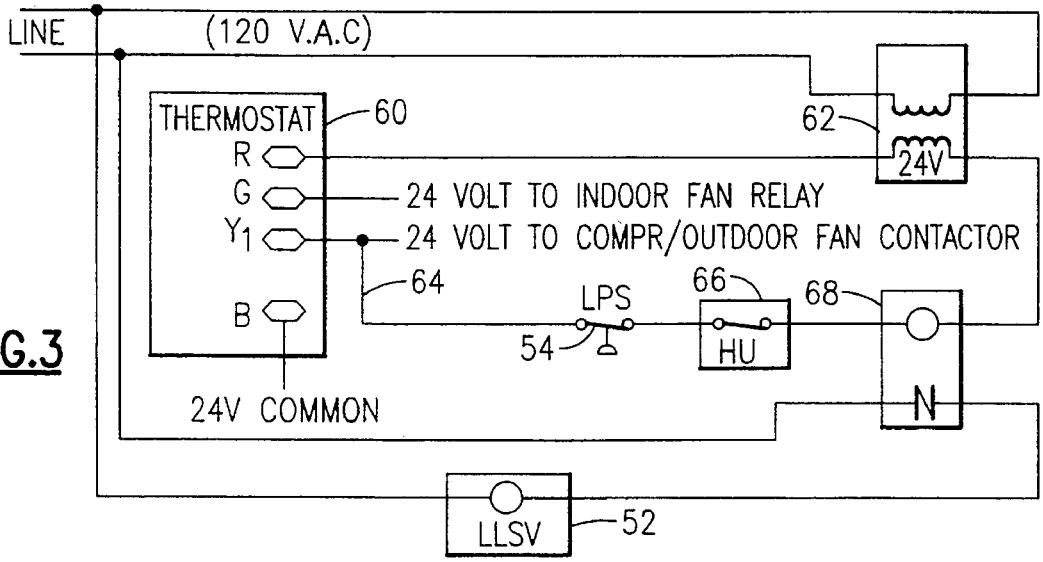
FIG. 3 shows a thermostatic control circuit employed in connection with an embodiment of this invention.

The thermostat control arrangement for high latent refrigerant control can be explained with reference to FIG. 3. A thermostat device 60 located in the building comfort space is used in connection with a transformer 62 that provides 24 v.a.c. transformer voltage. Line voltage at 120 v.a.c. is also available, and powers the transformer 62. The thermostat has a return lead R to the transformer 62, a fan lead G to the indoor fan relay (not shown) and a cooling lead $Y_1$ that controls the compressor and outdoor fan contactor (not shown), which actuates the compressor 12 when a predetermined cooling setpoint is reached or exceeded and there is a call for cooling. A humidity control line 64 is tied to the cooling lead $Y_1$ and connects, in series, the low-pressure switch 54 and a wall-mounted humidistat 66 located in the comfort space. In this embodiment a control relay 68 is also disposed in series in the humidity control line 64, with output leads supplying line voltage to the liquid line solenoid valve 52. However, if the 24 volt transformer 62 has sufficient power, the humidity control line can power the solenoid relay 52 directly.

The wall-mounted humidistat 66 directly energizes and de-energizes the bypass liquid line solenoid valve 52 taking the subcooler coil 44 into and out of the refrigerant circuit. When the compressor suction pressure is extremely low, the low pressure switch will detect this condition and take the subcooler coil 44 out of circuit, helping to prevent evaporator coil freeze-up.

Figure 4:
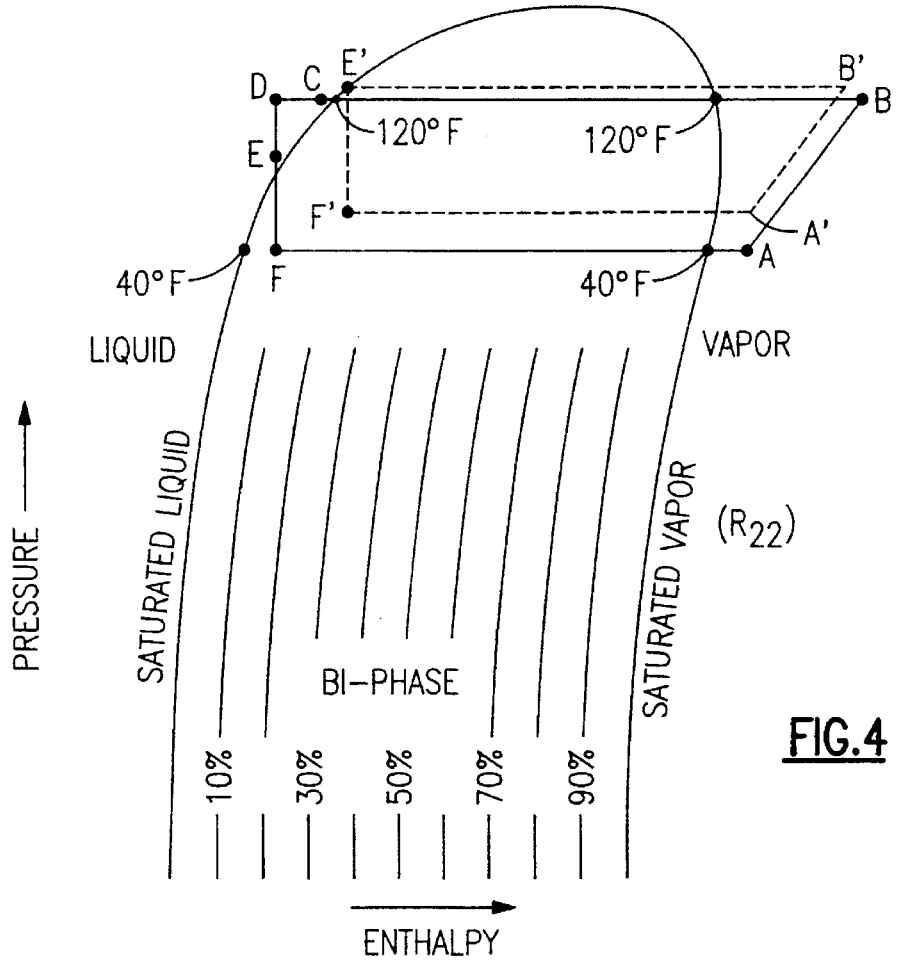
FIG. 4 is a pressure-enthalpy diagram for explaining the operation of this embodiment.

FIG. 4 is a system pressure-enthalpy diagram for explaining the refrigerant heat flow in the system, ignoring general system losses. Here pressure is along the vertical axis or ordinate, and enthalpy is on the horizontal axis or abscissa. In this embodiment, the refrigerant working fluid is R22, and liquid, vapor, and bi-phase regions are generally as labeled. The solid line graph represents the air conditioner mode with the subcooler coil 44 in circuit (high latent cooling), while the dash line graph represents the bypass mode (normal cooling). Point A represents the state of the refrigerant leaving the evaporator coil 22 and entering the compressor 12. Point B represents the state of the refrigerant leaving the compressor and entering the condenser 14. In the condenser, the enthalpy is reduced, largely by condensing into the liquid state yielding up heat to the outside air. At point C, the refrigerant, having condensed, leaves the condenser 14 and enters the subcooler coil 44. In the subcooler, the enthalpy of the refrigerant is reduced by reducing the liquid temperature left of the liquid saturation line. Then at point D, the sub-cooled refrigerant liquid passes to the pressure restrictor 48, and undergoes a pressure reduction to point E, where the liquid enters the throttling device or expanding device 20. At point F the refrigerant enters the evaporator coil 22 as a mixture of liquid and vapor phases at low pressure. As the refrigerant passes through the coil 22, the liquid refrigerant evaporates until only vapor leaves the coil and returns to the suction side of the compressor (Point A).

When the bypass solenoid 52 is open and the subcooler coil 44 is taken out of the circuit, then the refrigerant follows the pressure-enthalpy graph shown in broken line in FIG. 4. The refrigerant vapor enters the suction port of the compressor 12 at point A' leaves the compressor discharge port P at point B' and enters the condenser 16. Because the circuit now bypasses the subcooler coil 44 and the flow restrictor 48, the liquid refrigerant enters the expander device 20 at point E' and is released at point F' at reduced pressure into the evaporator coil 22. Here, it should be noted, there is approximately the same pressure drop across the expander device 20 both in the subcooling (high latent cooling) mode (E to F) and in the bypass (normal cooling) mode (E' to F'). In the subcooling mode the refrigerant fluid in the evaporator and at the suction port of the compressor is at a somewhat lower pressure than in the bypass mode. This means that the evaporator coil is a few degrees cooler in the high latent cooling mode than in the normal cooling mode, thereby condensing more moisture and reducing the wet-bulb temperature of the leaving air below what is achieved in the bypass mode.

Figure 5:
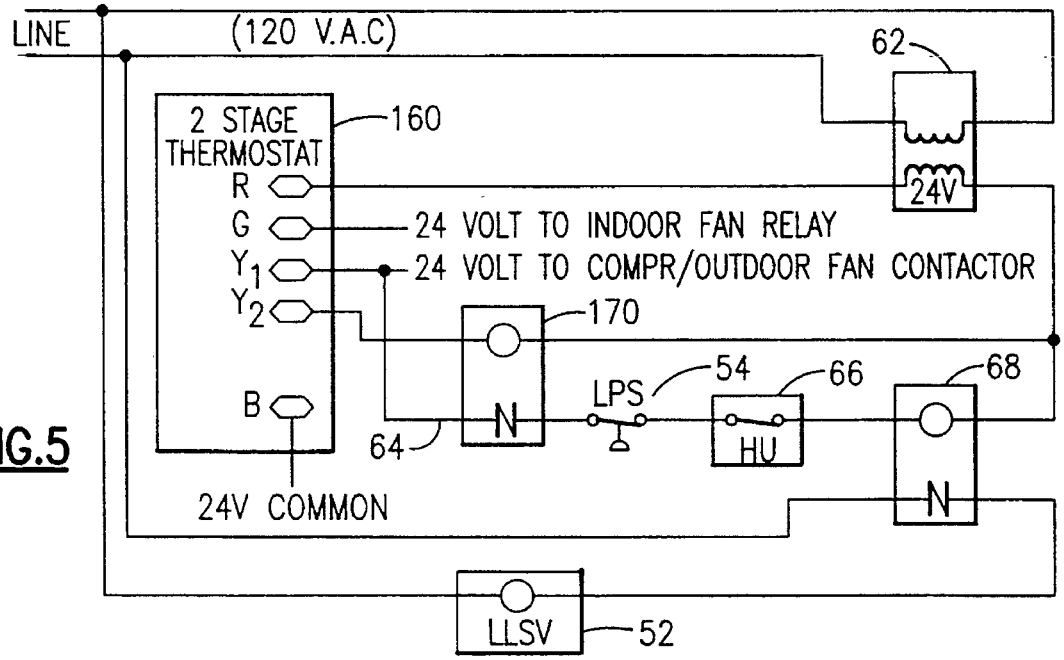
FIG. 5 shows a thermostatic control circuit employed in connection with another embodiment of this invention.

A thermostat control for a two-stage system is shown in FIG. 5. Elements that correspond to the elements described with reference to FIG. 3 are identified here with similar reference characters, and a detailed description thereof will not be repeated. In this embodiment, a two-stage thermostat 160 is associated with the thermostat transformer, and has a return lead R, a fan lead G, and a cooling lead $Y_1$ as described previously. In addition there is a second cooling lead $Y_2$ which becomes actuated when a second temperature setpoint is reached or exceeded that is higher than the setpoint for the cooling lead $Y_1$. The low-pressure switch 54, humidistat 66 and control relay are connected as previously on humidity control line 64 which is tied to the cooling lead $Y_1$. In addition, a second control relay 170 has its actuator connected to the second cooling lead $Y_2$ and its output leads connected in series in the humidity control line 64.

In this embodiment, should the temperature in the occupied comfort space continue to rise past the second, higher setpoint, the second stage of cooling will over-ride the high latent subcooler and take it out of operation. This allows the air conditioning system 10 to achieve its full sensible cooling effect. Then, once the air-conditioned space is returned to an acceptable temperature below the upper setpoint, the second stage of cooling is satisfied, and the subcooler is allowed to come back into the circuit whenever the humidistat 66 calls for dehumidification.

Figure 6:
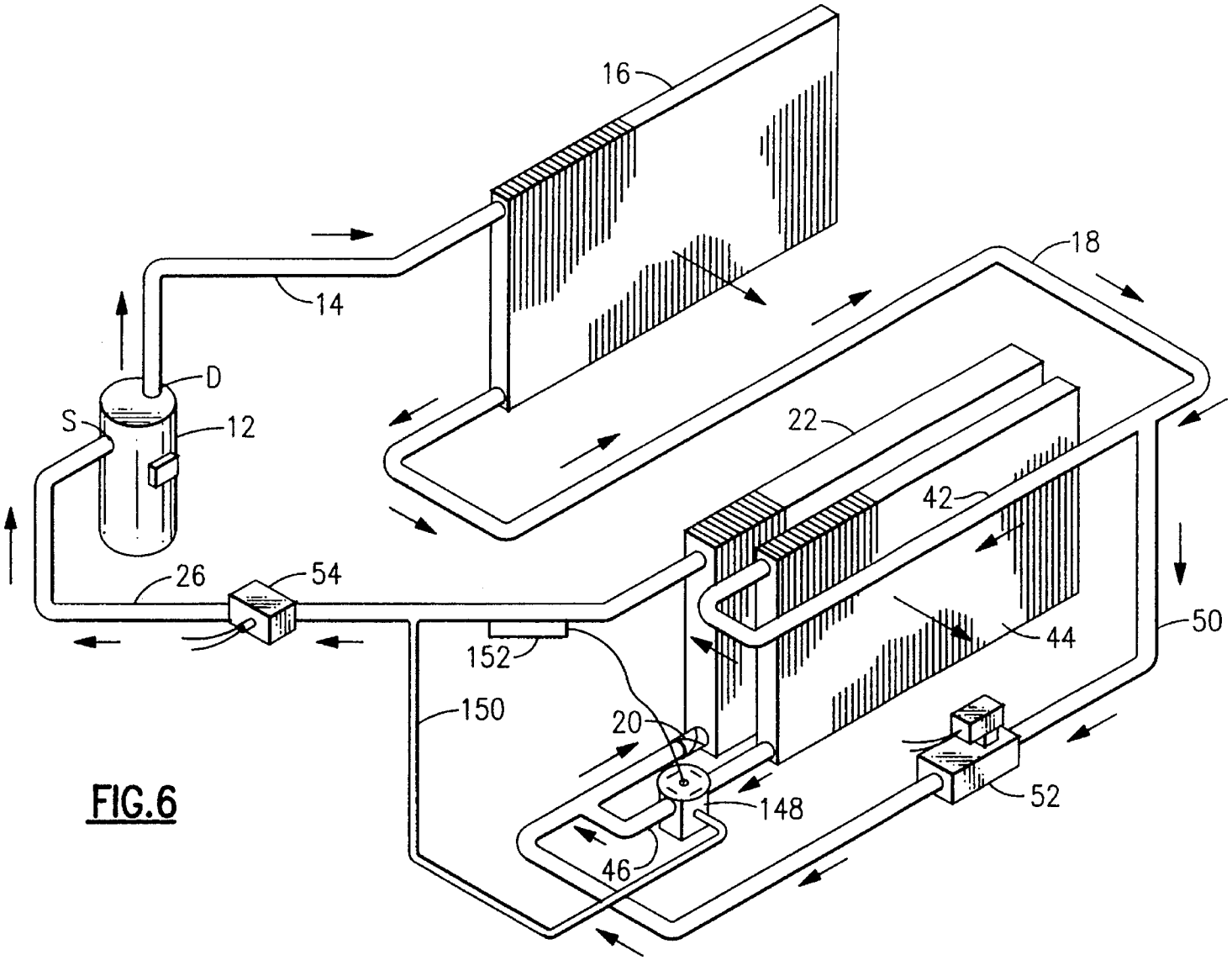
FIG. 6 is a schematic view of an air conditioning system employing a subcooler, according to a further embodiment of this invention.

A further embodiment of the improved high latent cooling system is shown in FIG. 6. Here, elements that are also common to the air conditioning systems of FIGS. 1 and 2 are identified with the same reference numbers, and a detailed description is omitted. In this embodiment, the operative difference from the FIG. 2 embodiment is that the fixed flow restrictor 48 is replaced with a thermostatic expansion valve 148. The thermostatic expansion valve, or TXV, is a known device that is frequently employed as an expansion valve at the inlet to an evaporator, although in this embodiment the TXV 148 is used to reduce the pressure of the condensed liquid leaving the subcooler coil 44 before it reaches the expansion device 20 associated with the evaporator coil 22. The TXV 148 has an equalizer line 150 coupled to the low-pressure vapor line 26, and a temperature detecting bulb 152 located on the line 26 downstream of the evaporator coil 22 and before the suction port S of the compressor 12. The TXV modulates the flow of the sub-cooled refrigerant liquid in accordance with the refrigerant temperature and suction pressure. This arrangement ensures that there is a constant superheat into the compressor suction, so that there is no compressor flooding. The TXV 148 drops the refrigerant pressure, but keeps the pressure above the point at which a two-phase (liquid and vapor) exists, i.e., approximately at point E of FIG. 4. The downstream expansion device 20 will then function to drop the pressure of the refrigerant fluid entering the evaporator coil into the point of two-phase or choked flow. This permits the subcooler arrangement to accommodate a wide variety of air conditioning and dehumidification loads, while maintaining acceptable operation conditions.

The subcooler assembly 40 according to any of the embodiments of this invention can be provided as a "drop-in" system modification, requiring very little effort to install, and which will fit easily into the space available in existing air conditioning systems. As moisture condensation takes place only on the existing evaporator coil, no additional apparatus is needed for collection of the condensate. The subcooler assembly only requires bolting on of the subcooler coil 44, installation of the piping represented by the branches 42, 50 and 46, and the rather straightforward electrical connections to the thermostat as shown in FIGS. 3 and 5.

Because only the single additional coil 44 is disposed in the indoor air flow path 24, the indoor fan load is not increased appreciably.

While the invention has been described hereinabove with reference to certain preferred embodiments, it should be recognized that the invention is not limited to those precise embodiments. Rather, many modification and variations would present themselves to persons skilled in the art without departing from the scope and spirit of this invention, as defined in the appended claims.

We claim:

1. Air conditioning apparatus with controlled latent cooling comprising a compressor having a suction side to which a working fluid is supplied as a vapor at low temperature and a discharge side from which the working fluid is discharged as a vapor at a high pressure and elevated temperature; a condenser heat exchanger supplied with said vapor at high pressure for exhausting heat from the working fluid and discharging the working fluid as a liquid at high pressure; an indoor evaporator coil supplied by a liquid line from said condenser heat exchanger with said working fluid at high pressure, including expansion valve means for reducing the pressure of said working fluid to liquid at said low pressure and heat exchanger means in which heat from a stream of indoor air is absorbed by said low pressure liquid such that said working fluid is converted to a low pressure vapor and said low pressure vapor is passed to the suction side of said compressor; and means for reducing the relative humidity of the indoor air leaving said indoor coil, including a sub-cooler heat exchanger having an inlet coupled to said condenser heat exchanger to receive said high pressure liquid and an outlet coupled to the expanding valve means of said indoor evaporator, said sub-cooler heat exchanger being positioned in the indoor air stream leaving said indoor evaporator heat exchanger means for subcooling said working fluid and raising the temperature of said leaving indoor air stream, and control means operative, when cooling and dehumidification are called for, to route the high pressure liquid working fluid first through said sub-cooler heat exchanger and then to said indoor evaporator coil, and when cooling-only is called for, to bypass the sub-cooler heat exchanger and route the high pressure liquid working fluid from said condenser heat exchanger directly to said evaporator coil; wherein said liquid line has a first branch coupled to the expansion valve means of said evaporator coil and a second branch coupled to the inlet of said sub-cooler heat exchanger, and a second liquid line couples the outlet of said sub-cooler heat exchanger to the expander valve means of said evaporator coil, said second liquid line including a flow restrictor device, and said control means including a liquid line solenoid valve interposed in said first branch and control circuit means coupled to said solenoid valve for opening said solenoid valve when cooling only is called for and closing said solenoid valve when cooling and dehumidification are called for; and wherein said control circuit includes a thermostat having a cooling lead that supplies a signal to actuate said compressor when a cooling setpoint temperature is reached; and a humidity control line coupled to said cooling lead including a humidistat in series with control lead means for actuating said liquid line solenoid valve.

2. Air conditioning apparatus according to claim 1 wherein said control circuit includes a low pressure switch in series in said humidity control line, and in fluid communication with the suction side of said compressor for detecting a low-pressure condition on the suction side of said compressor.

3. Air conditioning apparatus according to claim 1 wherein said solenoid valve is normally closed and opens when actuated.

4. Air conditioning apparatus according to claim 1 wherein said solenoid valve is normally open and closes when actuated.

5. Air conditioning apparatus according to claim 1 wherein said thermostat is a two-stage thermostat having a second cooling lead that is energized when a second, higher setpoint is reached, and said control circuit further includes a control relay coupled to said second cooling lead and actuated thereby, and having power leads in series with said humidity control line.

6. Air conditioning apparatus according to claim 1 wherein said liquid line solenoid valve is a line-powered device, and said control leads include a control relay having an actuator in series in said humidity control line and power leads coupled to a source of line power and to said liquid line solenoid valve.

7. Air conditioning apparatus according to claim 1 wherein said flow restrictor device includes a thermostatic expansion valve.

8. Air conditioning apparatus according to claim 7 wherein said thermostatic expansion valve has an equalizer line coupled to said vapor line, and a temperature detector coupled to the vapor line downstream of the evaporator coil but before the suction side of said compressor.

9. Air conditioning apparatus according to claim 1 wherein said flow restrictor device includes an automatically adjusting flow restriction device so as to ensure a constant amount of superheat in the working fluid fed to the compressor suction side from said sub-cooler heat exchanger.

* * * * *